US007025331B2

(12) United States Patent
Whelan

(10) Patent No.: US 7,025,331 B2
(45) Date of Patent: Apr. 11, 2006

(54) PRYING TOOL WITH POSITIONABLE HANDLE

(76) Inventor: Patrick J. Whelan, 305 S.E. 21st St., Troutdale, OR (US) 97060

( * ) Notice: Subject to any disclaimer, the term of this patent is extended or adjusted under 35 U.S.C. 154(b) by 0 days.

(21) Appl. No.: 10/682,258

(22) Filed: Oct. 8, 2003

(65) Prior Publication Data

US 2004/0069978 A1 Apr. 15, 2004

Related U.S. Application Data

(60) Provisional application No. 60/417,108, filed on Oct. 8, 2002.

(51) Int. Cl.
*B66F 15/00* (2006.01)

(52) U.S. Cl. ..... 254/25

(58) Field of Classification Search ..... 254/25, 254/26 R, 27, 131, 18, 23; 81/20, 22, 177.8, 81/119, 186, 177.2, 180.1
See application file for complete search history.

(56) References Cited

U.S. PATENT DOCUMENTS

| | | | | |
|---|---|---|---|---|
| 120,304 | A * | 10/1871 | McBride | 81/119 |
| 1,568,442 | A * | 1/1926 | Carver | 81/177.8 |
| 5,871,204 | A * | 2/1999 | Spirer | 254/26 R |
| 5,931,063 | A * | 8/1999 | Kuo | 81/119 |
| 5,996,448 | A * | 12/1999 | Suekage | 81/177.2 |
| 6,805,029 | B1 * | 10/2004 | Foster et al. | 81/186 |
| 2004/0069978 | A1 * | 4/2004 | Whelan | 254/25 |

* cited by examiner

*Primary Examiner*—Lee D. Wilson
(74) *Attorney, Agent, or Firm*—Marger Johnson & McCollom, PC

(57) ABSTRACT

Disclosed is a prying tool having a head portion and a handle portion. The handle portion can be positioned relative to an angle of the head portion. Additionally, in some embodiments, the handle portion can be separated from the head portion. Embodiments of the invention also include a tool head having an aperture with a predetermined shape that can be mated with a projection from a handle. The predetermined shape of the aperture and projection allows the handle to be attached to the removable head in a variety of positions.

26 Claims, 3 Drawing Sheets

32
20
32

14
10
32
34
30
26
22
26
28
30
12
16
16
18
22

34

PRYING TOOL WITH POSITIONABLE HANDLE

This application claims benefit of Provisional application No. 60/417,108 filed on Oct. 8, 2002.

TECHNICAL FIELD

This disclosure relates to a prying and lifting tool and, more particularly, to a prying and lifting tool having a positionable handle.

BACKGROUND OF THE INVENTION

Prying tools are used in a variety of situations. For instance, they can be used to remove pressed seals such as axel seals, and to remove pulleys and other attachments from shafts, among other uses. As shown in FIG. 1, a prying tool 10 generally has a head end 12 and a handle end 14. The head end 12 further includes one or two working ends 16 that, have a reduced thickness compared to the remainder of the head end. The working ends 16 allow the tool to get under or otherwise provide a lifting or prying point to remove a desired seal or other item. In operation, a user places one of the working ends 16 under the item to be removed, and rests an end 18 on a suitable surface. Once so positioned, the user rotates the handle 14 which causes the tool to rotate about a fulcrum at the end 18. This, in turn, causes the working end 16 to lift or otherwise force out the object to be removed.

Although useful, present pry tools are somewhat heavy, bulky, and cannot be used in tight situations. Embodiments of the invention address these and other limitations in the prior art.

DETAILED DESCRIPTION OF THE PREFERRED EMBODIMENTS

The prying tool according to embodiments of the invention includes a head portion and a handle portion. The handle portion can be positioned relative to the head portion. Additionally, in some embodiments, the handle portion can be separated from the head portion. Embodiments of the invention also include a tool head having an aperture with a predetermined shape that can be mated with a projection from a handle. The predetermined shape of the aperture and projection allows the handle to be attached to the removable head in a variety of positions.

Figures 1, 2, 3:
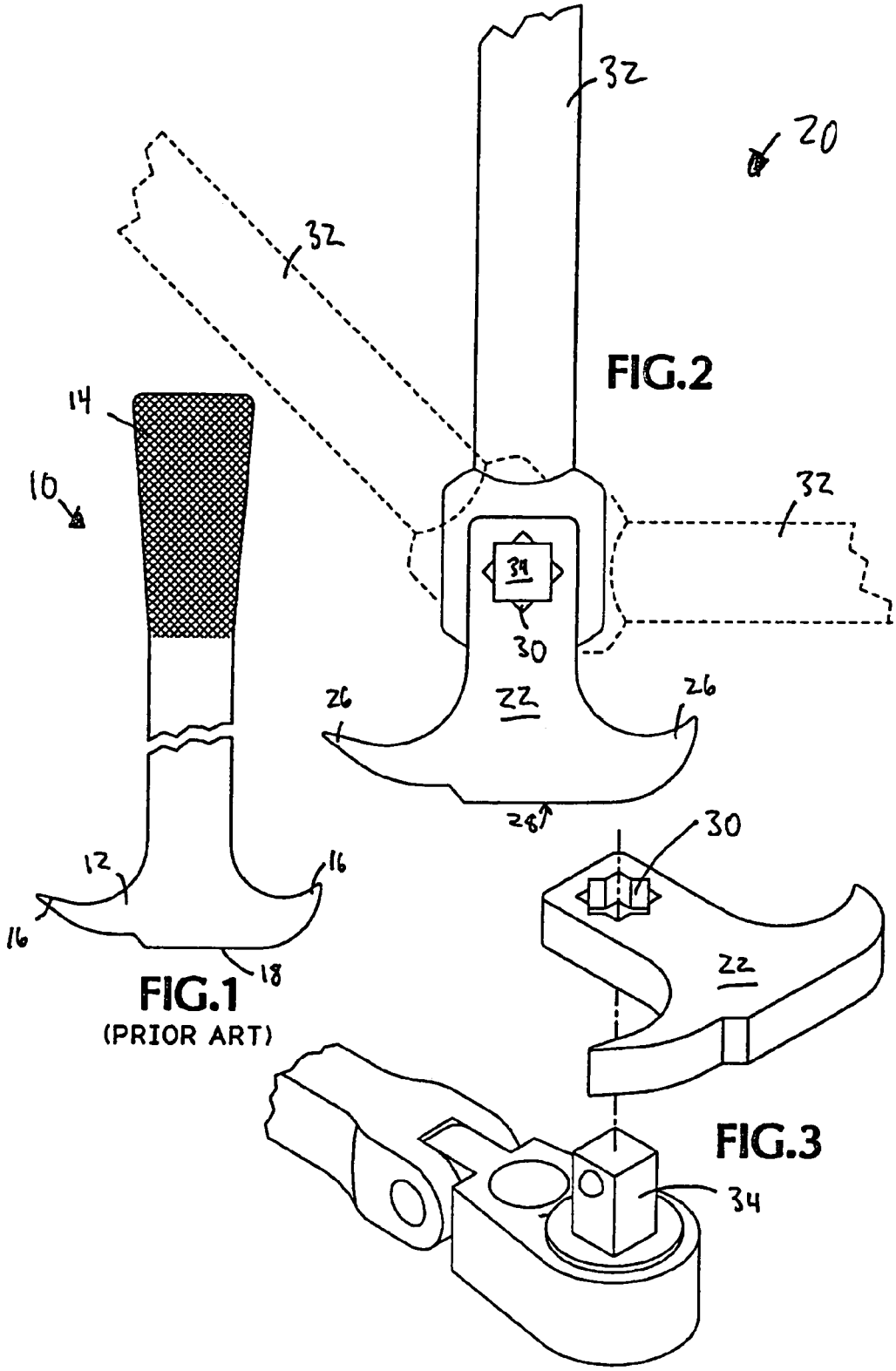
FIG.1 (PRIOR ART)
FIG. 1 is a line drawing showing a prying tool of the prior art.
FIG. 2 is a line drawing showing a prying tool according to an embodiment of the invention.
FIG. 3 is an isometric view showing how the prying tool of embodiments of the invention is assembled.

Referring to FIG. 2, a tool 20 according to embodiments of the invention is shown. The tool 20 includes a head 22 having a pair of working ends 26 and a resting end 28. Additionally, the head 22 has an aperture 30 created therein. A handle 32 includes a projection 34 suitably sized to be insertable into the aperture 30.

Preferably, the aperture 30 is formed so that the handle projection 34 may be inserted in a number of different positions, where each of the positions causes the handle to have a different position relative to the head 22. For instance, in one position, the projection 34 is inserted into the aperture 30 such that the handle 32 extends directly away from the head 22. In this position, the tool 20 is similar to the tool 10 of FIG. 1. Additionally, the projection 34 is insertable into the aperture 30 such that the handle 32 is positioned at an angle offset relative to the head 22. Two different handle positions relative to a static head 22 are shown in FIG. 2 in outline form. Thus, by selecting how the projection 34 of the handle 32 is inserted into the aperture 30, a user of the tool determines how the tool can best be used for a particular application. Specifically, the tool 20 has advantages when working in tight areas where the tool 10 of FIG. 1 could not be used. This is explained in detail below.

FIG. 3 illustrates how the projection 34 is inserted into the aperture 30 of the head 22. The handle 32 in FIG. 3 is illustrated as a ratchet type handle, i.e. one that can be used to turn the projection 34 when the handle is moved in one direction, and allows the projection 34 to remain stationary when the handle is moved in the opposite direction, as is well known in the art. Of course, the handle 32 need not be a ratchet-type, and any suitable handle 32 can be used. Additionally, if a ratchet-type handle is used, the projection of the handle 32 may be permanently fixed to the head 22. In this way, the handle would not need to be inserted into the head 22, but rather only the angle of the head 22 adjusted relative to the handle 32.

Figure 4:
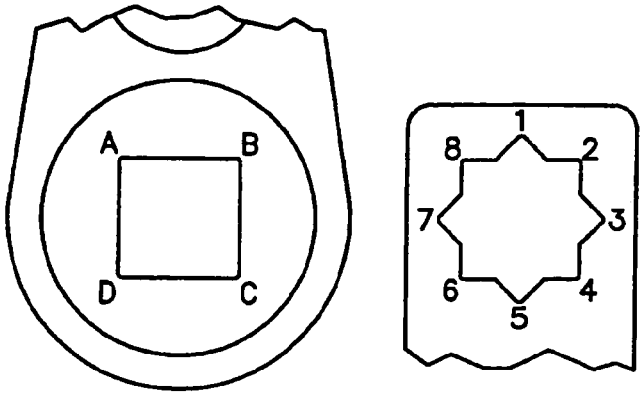
FIG. 4 is a line drawing illustrating how a removable handle can be inserted into the removable head of embodiments of the invention.

Referring back to FIG. 3, the tool user selects a position in which to insert the projection 34 of the handle 32 through the aperture 30. In the example shown in FIG. 3, the aperture 30 includes eight points while the projection 34 is square-shaped. As shown in FIG. 4, the projection 34 is illustrated as having four corners labeled A, B, C and D while the aperture 30 is shaped as an eight point star, labeled 1–8. Any one of the corners A, B, C or D of the projection 34 can be aligned with any one of the points 1–8 of the aperture 30. For instance, if corner A of the projection 34 is inserted into the aperture 30 such that it is adjacent to the point 1, then corner B will be aligned with point 3, corner C aligned with point 5, and corner D aligned with point 7. As described above, any of the corners of the projection 34 can align with any one of the points 1-A in the aperture 30. Thus, in this illustrated environment, there are eight different positions that the handle 32 can be positioned with respect to the head 22. Further, if the handle 32 is a ratcheting handle, then nearly any amount of desired angle offset between the handle 32 and the head 22 can be achieved by rotating the ratchet until the desired angle is selected.

Figure 5:
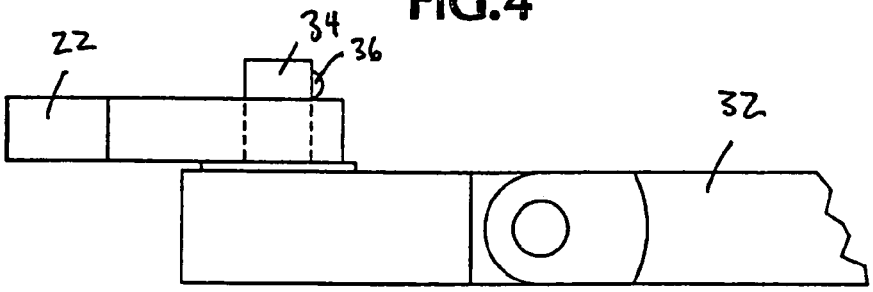
FIG. 5 is a side view showing an assembled tool according to embodiments of the invention.

FIG. 5 is a side view illustrating the handle 32 fully inserted through the aperture 30 of the head 22. In this illustrated embodiment, a retaining ball 36, which is generally integrated into the projection 34 and outwardly biased by a spring (not shown), is positioned such that it provides a frictional force tending to keep the head 22 attached to the handle 32. Of course, the retaining ball 36 need not be present in all embodiments of the handle 32, nor would the retaining ball 36 need to be fully positioned on the side of the head 22 opposite the handle 32, as shown in FIG. 5. In other words, if the head 22 was as thick as or thicker than the size of the projection 34, the retaining ball 36 would not be visible extending beyond the edge of the head 22 opposite the inserted handle 32, but would still operate to tend to keep the head attached to the handle.

Figure 7:
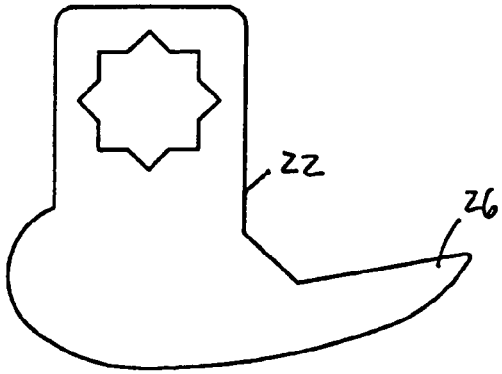
FIG. 7 is a line drawing of another tool head according to embodiments of the invention.
Figure 6:
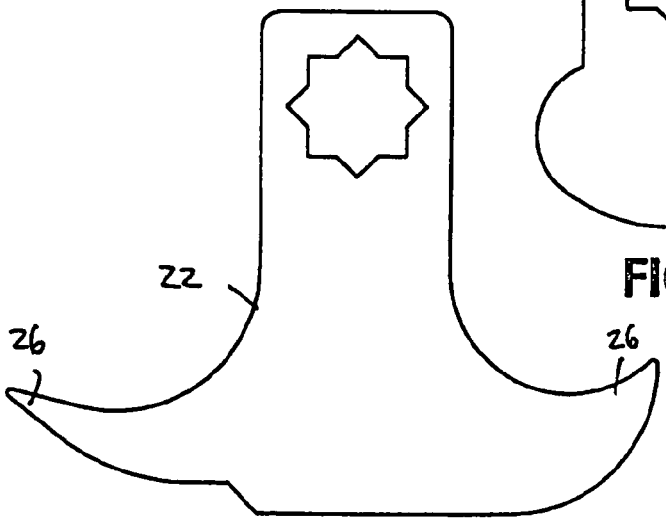
FIG. 6 is a line drawing of a tool head according to other embodiments of the invention.

FIGS. 6 and 7 illustrate two particular embodiments of the removable head 22. As shown in FIG. 6, the head 22 is shaped so as to be particularly advantageous in removing pressed seals, O-rings, bearings, or other smaller type devices. In particular, the working ends 26 of the head 22 are generally elongated and may in fact be quite narrow. Conversely, the head 22 of FIG. 7 only includes one elongated working end 26, which is shorter and thicker than the long working end 26 of the head 22 of FIG. 6. This decreased length and increased thickness of the working end 26 of the head 22 shown in FIG. 7 allows the head 22 to be particularly well suited as a prying tool. Of course, embodiments of the invention can include removable heads 22 having almost any shape suitable for almost any picking, pulling, prying, lifting, moving function. Additionally, the removable heads 22 can be sized to perform different functions while still able to operate with the same handle 32. In such embodiments, no matter the size of the head 22 or working ends 26 of the particular tool, the aperture 30 is sized to receive the projection 34 from the handle 32. Thus, instead of forcing a user to carry a full different tool for each size, users can be fully prepared for any size pulling or prying job with a minimum of different types of tools. For example, instead of carrying four different sized tools 10 of the prior art, users of embodiments of the invention could carry a single handle 32 and four replaceable heads 22, thus saving weight and space in a toolbox.

Not only can the heads 22 have different sizes, the aperture 30 in the heads 22 can be sized to accept "extensions", such as those used for socket-type wrenches, or other types of extensions. As is known in the art, an extension can be coupled between the handle and tool head to extend the tool head from the handle. Extensions can come in different sizes, from less than 1 inch to greater than 36 inches. In this way, the tool head is "extended" away from the handle by the length of the extension. Thus, the tool head may be able to be operated when extended away from the handle when otherwise not operable, due to the handle striking surfaces when working in tight areas.

In particular, with reference to FIG. 6, a first example size could have a length of about 5 inches, an overall width of about 5½ inches, a neck width (the width of the head 22 surrounding the aperture 30) of about 1.6 inches, have an aperture 30 sized to accept a ¾ inch projection 34, and be formed of a sturdy metal, such as steel (one example of which is AR (Abrasion Resistant) steel, such as AR400), chromed steel, iron, or titanium having a thickness of about ¼ inch. A second example could have a length of about 4.2 inches, an overall width of about 4½ inches, a neck width of about 1.4 inches, have an aperture 30 sized to accept a ½ inch projection 34, and have a thickness of about 3/16 inch. A third example could have a length of about 3.2 inches, an overall width of about 3½ inches, a neck width of about 1 inch, have an aperture 30 sized to accept a ⅜ inch projection 34, and have a thickness of about ⅛ inch. A fourth example could have a length of about 2.3 inches, an overall width of about 2.4 inches, a neck width of about 0.7 inches, have an aperture 30 sized to accept a ¼ inch projection 34, and be formed from metal having a thickness of about 10 gauge. Of course, these specific sizes described above are simply example sizes, and the invention can be practiced by tools having different sizes or shapes than those shown in FIG. 6 and described herein.

With reference to FIG. 7, a first example size could have a length of about 2½ inches, an overall width of about 3.7 inches, a neck width of about 1¼ inches, have an aperture 30 sized to accept a ½ inch projection 34, and have a thickness of about ¾ inch. A second example could have a length of about 2 inches, an overall width of about 3 inches, a neck width of about 1 inch, have an aperture 30 sized to accept a ⅜ inch projection 34, and have a thickness of about ⅝ inch. A third example could have a length of about 1.6 inches, an overall width of about 2.4 inches, a neck width of about 0.8 inches, have an aperture 30 sized to accept a ⅜ inch projection 34, and have a thickness of about ½ inch. A fourth example could have a length of about 1 inch, an overall width of about 1½ inches, a neck width of about ½ inch, have an aperture 30 sized to accept a ¼ inch projection 34, and have a thickness of about ⅜ inch. As above, these specific sizes are simply example sizes and the invention can be practiced by tools having different sizes or shapes than those shown in FIG. 7 and described herein.

Figure 8:
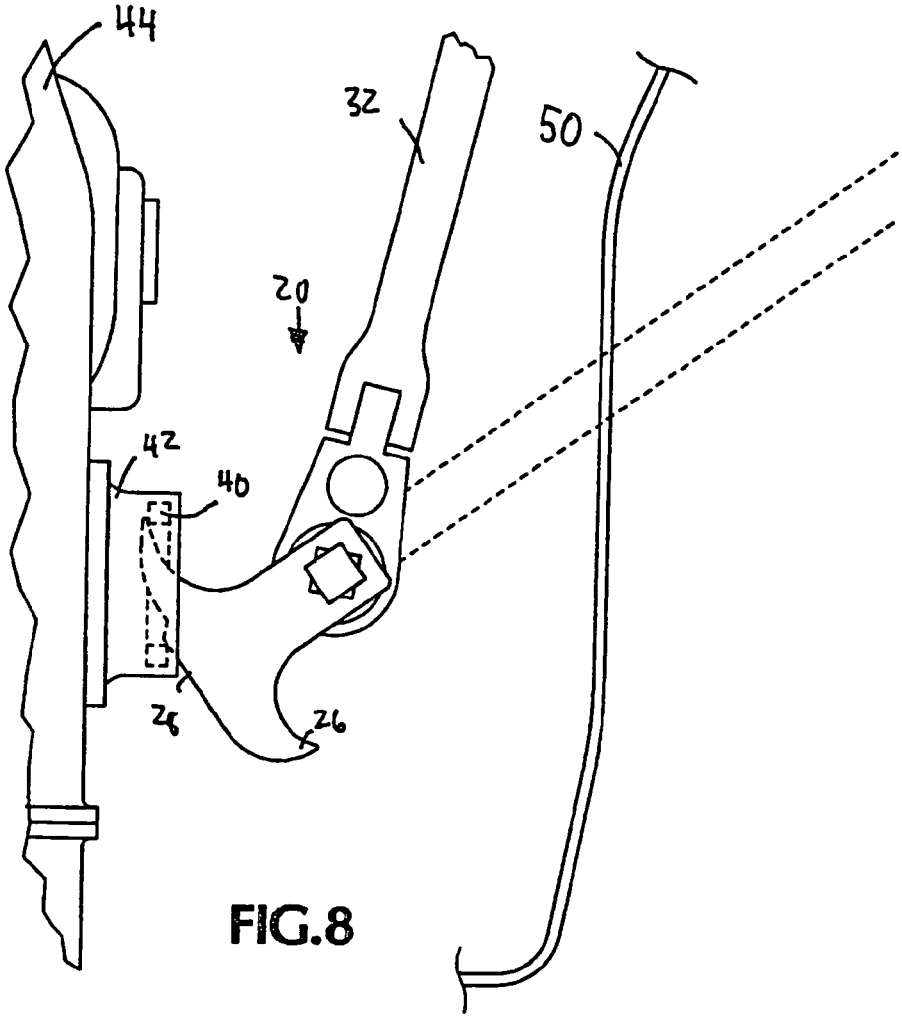
FIG. 8 is a side view drawing showing embodiments of the invention in use.

An example of some of the advantages of the tool 20 are shown in FIG. 8. That figures illustrates the tool 20 being used to remove an engine seal 40 from its housing 42. When an engine 44 is transverse mounted in an automobile, engine seals typically have less clearance between the engine 44 and a sidewall 50 or other impediment than if the engine were not transverse mounted. Because, especially in modern automobiles, the engine is fitted into the engine compartment with very little extra room, there is not much distance between the engine 44 and the sidewall 50. To remove the seal 40 from its housing 42, a seal puller or some prying tool must be used. Using an incorrect tool, such as a screwdriver, can damage the housing 42. If the housing 42 is damaged, a new seal 40 will not seat correctly, and the seal will leak. However, as indicated by dotted lines, a tool 10 as shown in FIG. 1 would not have enough clearance to operate. In other words, if the handle 32 extends directly from the head in the tool 10, it would hit the sidewall 50; thus, there is not enough clearance for the tool 10 to operate. Instead, when using the tool 20 according to embodiments of the invention, the handle 32 can be offset from the head 22. Thus, even in tight enclosures, there is adequate room for the tool 20 to operate.

In operation the handle 32,is set into the appropriate point of the aperture 30 so as to create adequate clearance for the tool 20 to operate. As shown in FIG. 8, the resting end 28 can sit on one end of the seal 40 while one of the working ends 26 is inserted just behind the edge of the seal 40. The operator of the tool 20 provides a downward force and the tool 20, acting as a first class lever having the resting end 28 as the fulcrum, causes the seal 46 to be removed without damaging the housing 44. As mentioned above, having eight positions in the aperture 30 allows the handle 32 to be inserted in any of eight positions relative to the head 22. Of course, more positions could be created in the aperture, but each additional point reduces the amount of working contact that the projection 34 has against the points of the aperture 30. Alternatively, if a ratchet handle is used for the handle 32, then dozens of possible working positions of the handle 32 relative to the head 22 can be set.

Figure 9:
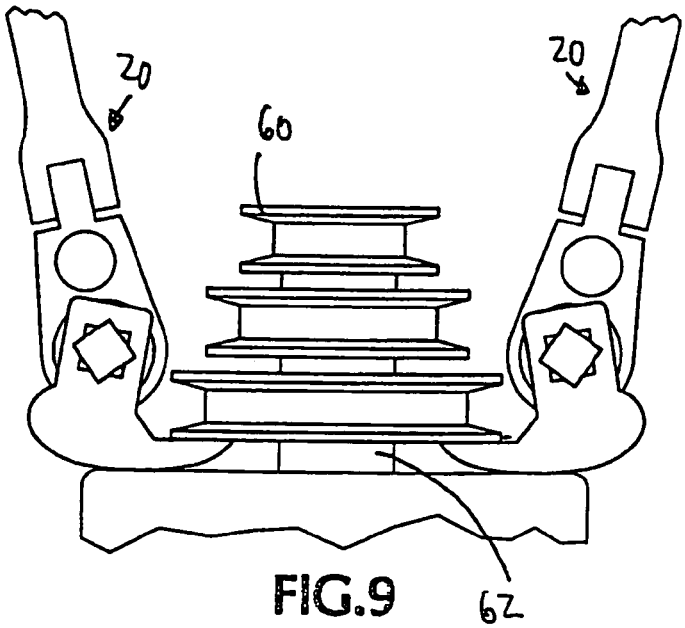
FIG. 9 is a side view drawing showing how two embodiments of the invention can be used in cooperation.

With reference to FIG. 9, multiple tools 20 can be used in tandem to provide multiple points of lifting force. In this example, two tools 20 are inserted under a pulley 60 that is to be removed from a shaft 62. In operation, once positioned, a user of the tools 20 provides a lifting force in concert, that is, the user presses on both tools 20 simultaneously, which causes a balanced lifting force to urge the pulley 60 off of the shaft 62. Because the handles 32 are positionable relative to the head 22, the user can position the handles to a position that is both comfortable and advantageous. Had the handles 32 not been positionable relative to the heads 22, the handles would be locked in a position that is uncomfortable and inefficient for the tool operator.

I claim:

1. A pry tool, comprising:

a relatively planar working end including a resting portion and an elongated working portion within a plane of the working end, wherein the elongated working portion extends generally perpendicular within the plane;

a handle having a non-circular projection structured to be inserted into the working end; and a non-circular receiver structured to accept the non-circular projection of the handle in at least a first position where the handle has a first relative offset angle to the working end and in at least a second position where the handle has a second relative offset angle to the working end, in which the non-circular projection and the non-circular receiver are structured to receive the projection of the handle in a direction perpendicular to the plane of the planar working end.

2. The pry tool of claim 1 wherein the projection of the handle is in a fixed position relative to a longitudinal axis of the handle.

3. The pry tool of claim 1 wherein the projection is structured to ratchet relative to the handle.

4. The pry tool of claim 1 wherein the receiver comprises an eight-pointed star pattern, each point offset 45 degrees from the next nearest point.

5. The pry tool of claim 1 wherein the receiver comprises a four-pointed pattern, each point offset 90 degrees from the next nearest point.

6. The pry tool of claim 1 wherein the projection of the handle is removeably inserted into the working end.

7. The pry tool of claim 1 wherein the working end has a single elongated working portion, and wherein the resting portion has a generally curved shape.

8. The pry tool of claim 1 wherein the working end has a first and a second elongated working portion, in which the resting portion has a generally flat shape.

9. The pry tool of claim 8, in which the first elongated working portion is narrower than the second elongated working portion.

10. The pry tool of claim 1, further comprising an extension affixed to the handle.

11. The pry tool of claim 10, wherein the extension is affixed to the handle between the handle and the working end.

12. A pry tool, comprising:

a relatively planar working end including a resting portion and an elongated working portion within a plane of the working end, wherein the elongated working portion extends generally perpendicular within the plane; and a receiving end including a non-circular receiver structured to accept a non-circular projection of a handle in at least a first position where such handle has a first relative offset angle to the working end and in at least a second position where such handle has a second relative offset angle to the working end, in which the non-circular receiver is structured to receive a non-circular projection of a handle in a direction perpendicular to the plane of the planar working end.

13. The pry tool of claim 12 wherein the receiver comprises an eight-pointed star pattern, each point offset 45 degrees from the next nearest point.

14. The pry tool of claim 12 wherein the receiver comprises a four-pointed pattern, each point offset 90 degrees from the next nearest point.

15. The pry tool of claim 12 wherein the working end has a single elongated working portion, and wherein the resting portion has a generally curved shape.

16. The pry tool of claim 12 wherein the working end has a first and a second elongated working portion, in which the resting portion has a generally flat shape.

17. The pry tool of claim 12, in which the first elongated working portion is narrower than the second elongated working portion.

18. A method of prying, comprising:

adjusting a longitudinal axis of a handle relative to a position of a relatively planar working end of a pry tool, wherein adjusting a longitudinal axis of a handle includes inserting a non-circular projection of a handle into a non-circular receiving portion of the working end of the pry tool perpendicular to a plane of the working end of the pry tool;

locating an elongated working portion of the pry tool under a portion of an object that is to be pried, wherein the elongated working portion is within the plane of the working end and extends generally perpendicular within the plane;

placing a resting end of the pry tool against a surface of an object that is not to be pried, wherein the resting end is within the plane of the working end; and rotating the pry tool about the resting end to move the object that is to be pried.

19. The method of claim 18 wherein adjusting a longitudinal axis of a handle comprises inserting the projection of the handle in one of a plurality of possible positions in the receiving portion of the pry tool.

20. The method of claim 19 wherein the number in the plurality of possible positions is four.

21. The method of claim 19 wherein the number in the plurality of possible positions is eight.

22. The method of claim 18 wherein adjusting a longitudinal axis of a handle comprises inserting a projection of a ratcheting handle into the receiving portion of the working end of the pry tool.

23. The method of claim 22, further comprising rotating the ratcheting handle relative to the pry tool.

24. The method of claim 18, further comprising affixing an extension to the handle.

25. The method of claim 24, wherein affixing an extension to the handle includes affixing an extension to the handle between the handle and the working end of the pry tool.

26. A seal puller, comprising a relatively planar structure including a prying tip extending generally perpendicular within a plane of the planar structure, a relatively flat resting portion along the edge of the planar structure and a non-circular hole through the structure having a through direction perpendicular to the planar structure and being structured to receive and affix a non-circular projection of a handle in a first position and to receive and affix a non-circular projection of a handle in a second position.

* * * * *